US007025206B2

(12) United States Patent
Sommer

(10) Patent No.: US 7,025,206 B2
(45) Date of Patent: Apr. 11, 2006

(54) DISPOSABLE PLATE WITH HANDLE AND METHOD OF STACKING

(76) Inventor: Michael Matthew Sommer, 129 Prospect St., Fredonia, NY (US) 14063

( * ) Notice: Subject to any disclaimer, the term of this patent is extended or adjusted under 35 U.S.C. 154(b) by 74 days.

(21) Appl. No.: 10/434,133

(22) Filed: May 8, 2003

(65) Prior Publication Data

US 2004/0222120 A1 Nov. 11, 2004

(51) Int. Cl.
*B65D 21/02* (2006.01)

(52) U.S. Cl. ..... 206/515; 220/574

(58) Field of Classification Search ..... 206/515, 206/519; 220/757, 574, 495.03; 229/402
See application file for complete search history.

(56) References Cited

U.S. PATENT DOCUMENTS

| | | | | | |
|---|---|---|---|---|---|
| 700,653 | A * | 5/1902 | Jobson | 215/227 |
| 1,886,171 | A * | 11/1932 | Dodge et al. | 206/517 |
| 2,582,183 | A * | 1/1952 | Weidler | 229/406 |
| 2,659,527 | A * | 11/1953 | Liebenow | 229/402 |
| 2,669,379 | A * | 2/1954 | Olson | 220/574 |
| 2,840,292 | A * | 6/1958 | Stoddard | 229/401 |
| 3,137,409 | A * | 6/1964 | David | 220/380 |
| 3,303,964 | A * | 2/1967 | Luker | 206/519 |
| 3,499,825 | A * | 3/1970 | Falcone Jr. et al. | 435/305.1 |
| 3,672,538 | A * | 6/1972 | Wiedemann | 206/519 |
| 4,049,187 | A * | 9/1977 | Florian | 229/402 |
| 6,186,395 | B1 * | 2/2001 | Kennett | 229/402 |

* cited by examiner

*Primary Examiner*—Gary E. Elkins
(74) *Attorney, Agent, or Firm*—Phillips Lytle LLP

(57) ABSTRACT

The present invention provides a disposable plate (10) with a handle portion (15) along a portion of its circumference, said disposable plate capable of being stacked upon like disposable plates to form a stack (20), which handle portion provides support for holding the plate and means for taking hold of and separating the plate when stacked with other disposable plates. One aspect of the invention provides an apparatus and method of nesting or stacking a plurality of disposable plates together to form a stack (20), wherein the handle portions of such disposable plates are circumferentially spaced or staggered such that no handle portion (e.g., 24A, 24B, 24C) rests substantially upon the handle portion of the plate immediately adjacent to it in the stack, to permit efficient separation of such disposable plates.

4 Claims, 3 Drawing Sheets

DISPOSABLE PLATE WITH HANDLE AND METHOD OF STACKING

TECHNICAL FIELD

The present invention relates generally to disposable, hand-held plates and, more particularly, to a disposable plate with a handle or tab portion providing support for holding the plate and means for taking hold of and separating the plate when stacked with other disposable plates.

BACKGROUND ART

Prior art offers various types of disposable plates—made from, among other things, paper, paperboard, cardboard, Styrofoam and plastic—for use in place of permanent dinner plates at parties, picnics and other gatherings. Other adaptations of disposable plates provide means for holding the plates together with other items such as beverages or utensils. Many such disposable plates are not sufficiently rigid or stable. When loaded with food, the plates deform, fold or bend, and become difficult to hold securely. In addition, when such disposable plates are stacked or nested together, users encounter difficulty in taking hold of or separating such plates from each other. Moreover, many such disposable plates are complicated and/or expensive to manufacture.

The principal object of the present invention is to provide a simple, inexpensive hand-held plate for use at parties, picnics and other gatherings that provides a means for securely holding the plate, and for taking hold of and separating it from a stack of such plates.

DISCLOSURE OF THE INVENTION

With parenthetical reference to the corresponding parts, portions or surfaces of the disclosed embodiment, merely for purposes of illustration and not by way of limitation, the present invention is an improved disposable plate (10) and, more particularly, a disposable plate defined by a peripheral edge with a handle portion, or tab portion (15), disposed on the peripheral edge. The disposable plate has a main body portion (11) with a center, a substantially planar bottom portion (12) and an outwardly sloping sidewall portion (13). Another aspect of the invention includes a substantially planar rim portion (14) encompassing the sidewall portion.

In one aspect of the invention, the plate includes a handle portion along a portion of its circumference. In another aspect of the invention, the handle portion has a rounded edge (15). In another aspect of the invention, the handle portion has three linear edges. In another aspect of the invention, the handle portion has two linear edges. In still another aspect of the invention, the plate is capable of being stacked or nested upon one or more other, like plates.

The disposable plate of the-present invention may be constructed by pressing paperboard or other material between dies, in a mold of pulp, or by any other conventional method.

In one aspect of the invention, the entire disposable plate, including a main body portion and a handle or tab portion, is manufactured or constructed from a single sheet of material, such as paper, paperboard, cardboard or plastic, for example. In another aspect, the tab portion of the disposable plate and the main body portion of the disposable plate are manufactured or constructed independently, and the tab portion is affixed to the peripheral edge of the main body portion by using, for example, an adhesive or other affixing method.

The invention in one aspect provides disposable plates which permit like empty plates to be stacked or nested one upon another to form a stack of disposable plates (20). In another aspect, the handle portions (15, 24A, 24B, 24C, 24D, 24E) are dimensioned and shaped to permit manipulation between the user's thumb and index finger.

Other aspects of the present invention include an apparatus and method of nesting or stacking a plurality of disposable plates together to form a stack (20), wherein the handle portions (24A, 24B, 24C, 24D, 24E) of such disposable plates are circumferentially spaced or staggered such that no tab portion rests upon the tab portion of the plate immediately below it in the stack. In one aspect of the invention, such circumferentially spaced or staggered tab portions form a spiral around the circumference of the stack. In another aspect of the invention, such circumferentially spaced or staggered tab portions are configured and arranged such that all of such tab portions may be folded upward or folded downward to rest substantially along the peripheral surface of the stack. In another aspect, the disposable plate is scored (16) along the radial line between the main body portion and the tab portion.

The general object of the invention is to provide an inexpensive means of securely holding a disposable plate.

Another object is to enable the user to stabilize the disposable plate by grasping the tab portion between the thumb and index finger.

Another object is to provide a simple and inexpensive means of separating a disposable plate from a series or stack of like disposable plates.

Still another object is to provide a method of stacking or nesting such plates with handle or tab portions to allow for easy and efficient separation.

Another object is to provide a disposable plate with the foregoing advantages which may be manufactured or constructed by methods currently used in the industry without incurring substantial manufacturing or retooling costs.

These and other objects and advantages will become apparent from the foregoing and ongoing written specification and the accompanying drawings.

DESCRIPTION OF THE PREFERRED EMBODIMENTS

Figure 1:
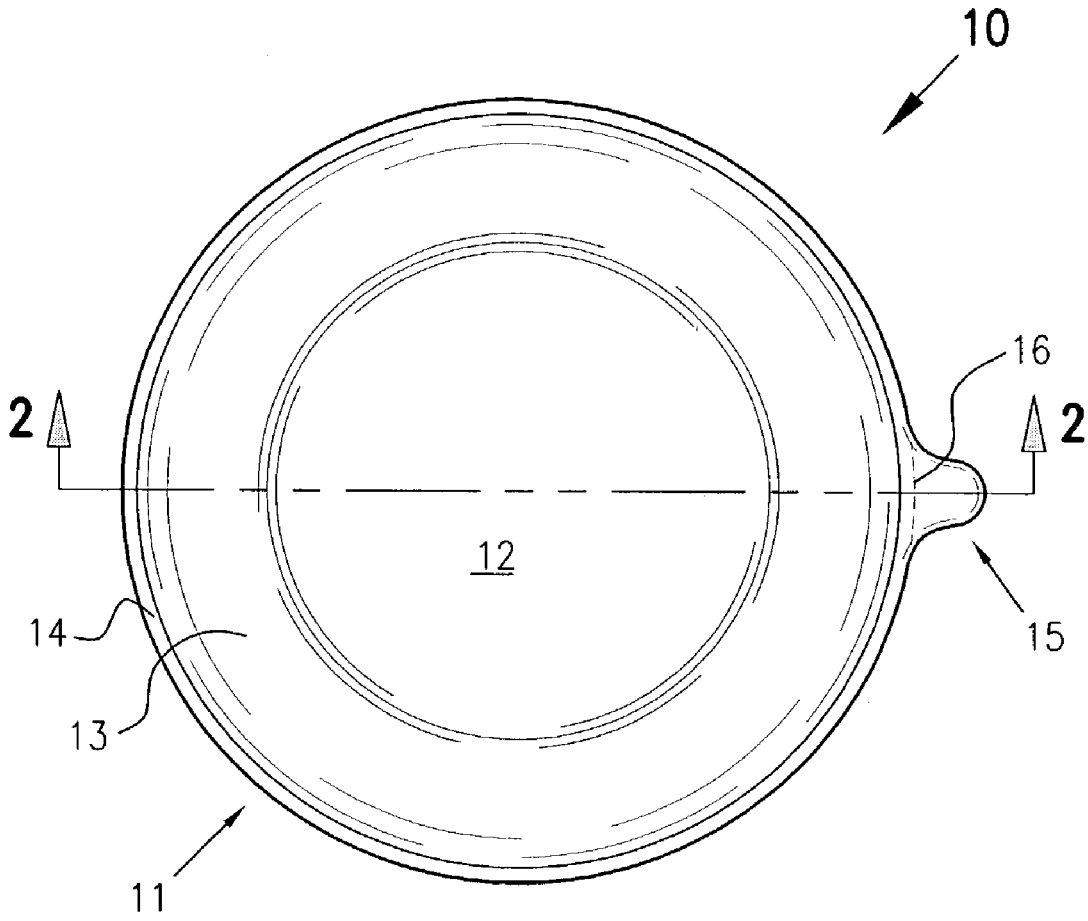
FIG. 1 is a top view of the disposable plate.

At the outset, it should be clearly understood that like reference numerals are intended to identify the same structural elements, parts, portions or surfaces consistently throughout the several drawing figures, as such elements, parts, portions or surfaces may be further described or explained by the entire written specifications, of which this detailed description is an integral part. Unless otherwise indicated, the drawings are intended to be read together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

Referring now to the drawings, the present invention provides an improved disposable plate, of which a first embodiment is generally indicated in FIG. 1. In FIG. 1, the plate is shown as having a main body portion 11 defined by a peripheral edge, which main body portion consists of a bottom planar portion 12, surrounded by an outwardly sloping sidewall portion 13, which itself is surrounded by a substantially planar rim portion 14. The main body portion of the disposable plate may also be constructed in other conventional shapes and contours, and may be constructed of any suitable material, including but not limited to paperboard, cardboard and fiberboard.

A handle portion with a rounded edge 15 is disposed upon the peripheral edge of the main body portion 11. The handle portion 15 may also be configured with two substantially linear edges, or three substantially linear edges. The handle portion in this embodiment is of a size such that the handle portion does not extend beyond a boundary defined by a square having the same center as the main body portion of the disposable plate, which square has sides equal in length to the diameter of the main body portion of the disposable plate. This limitation in size may, in some instances, and depending upon the method of manufacture, save waste and lessen the expense associated with the manufacture or construction of the improved disposable plate of the present invention.

In this embodiment, the handle portion 15 is held between the user's thumb and index finger, and the main body portion 11 is supported by the user's remaining fingers.

In this embodiment, the main body portion and the handle portion are made from a single piece of material, such as paper, paperboard or cardboard, or from a single mold, thus forming a single, continuous plate, with a score line 16 which defines the radial line between the main body portion 11 and the handle portion 15. In another embodiment, the main body portion and the handle portion are constructed independently, and the handle portion is affixed with an adhesive to the peripheral edge of the rim portion of the main body portion.

Figure 2:
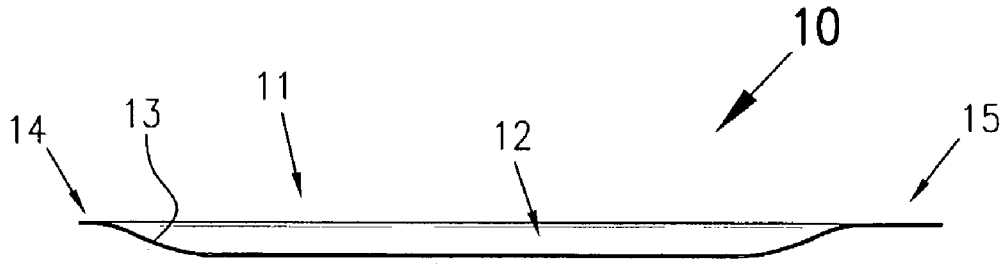
FIG. 2 is a side view of the disposable plate.
Figure 3:
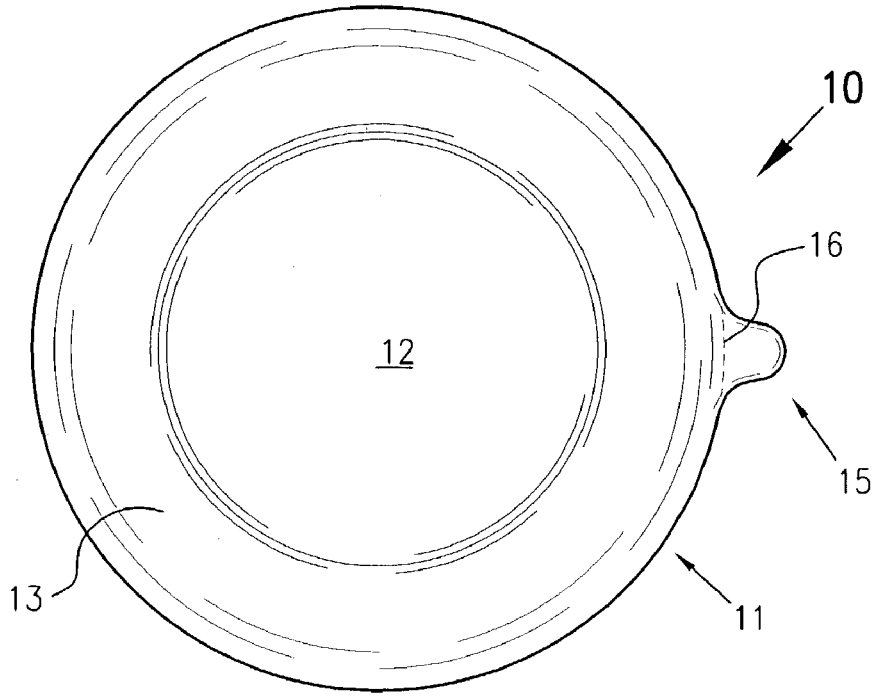
FIG. 3 is a bottom view of the disposable plate.

FIG. 2 and FIG. 3 depict side and bottom views, respectively, of the disposable plate illustrated in FIG. 1.

Figure 4:
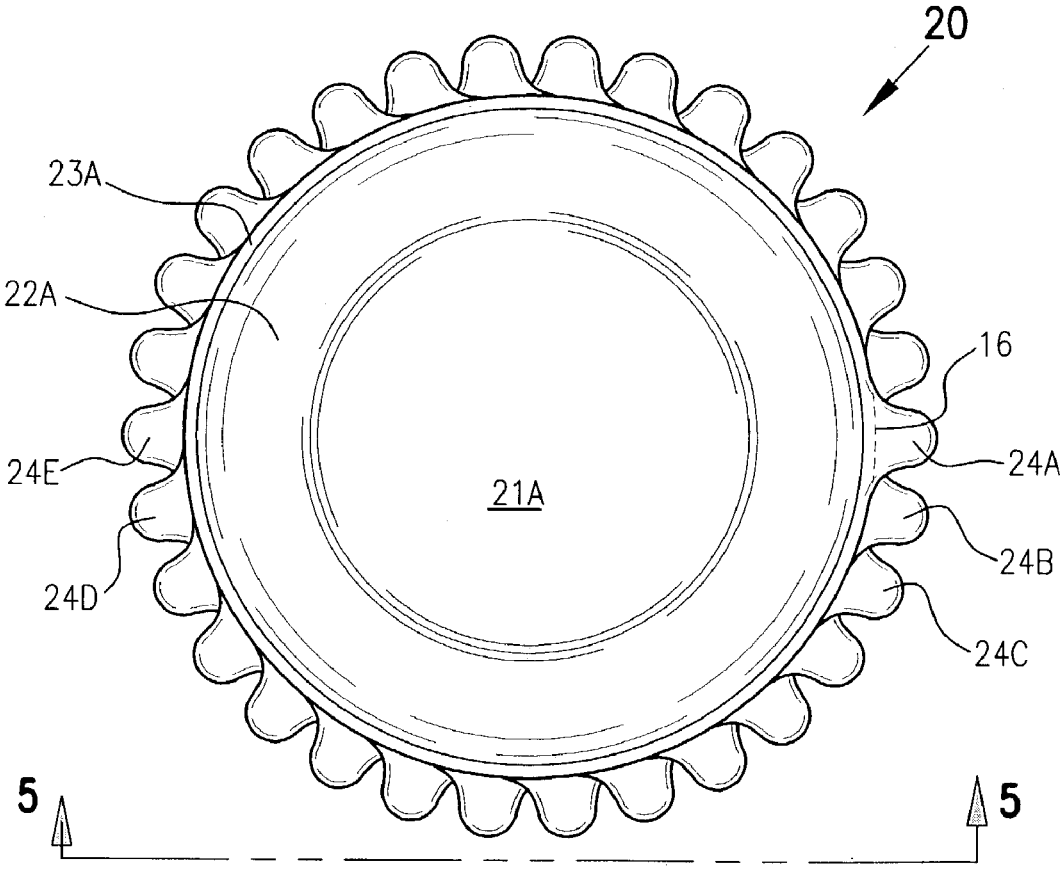
FIG. 4 is a top view of the disposable plate stack.

FIG. 4 depicts a plurality of disposable plates 20 with a corresponding plurality of handle portions, e.g. 24A, 24B, 24C in a stacked condition. The handle portions, as situated during the stacking process, are circumferentially spaced or staggered such that no handle portion rests upon the handle portion of the plate immediately below, creating a spiral of handles around the peripheral edge of the stack of plates. In this embodiment, each disposable plate has a bottom planar portion 21A, surrounded by an outwardly sloping sidewall portion 22A, which itself is surrounded by a substantially planar rim portion 23A.

Figure 5:
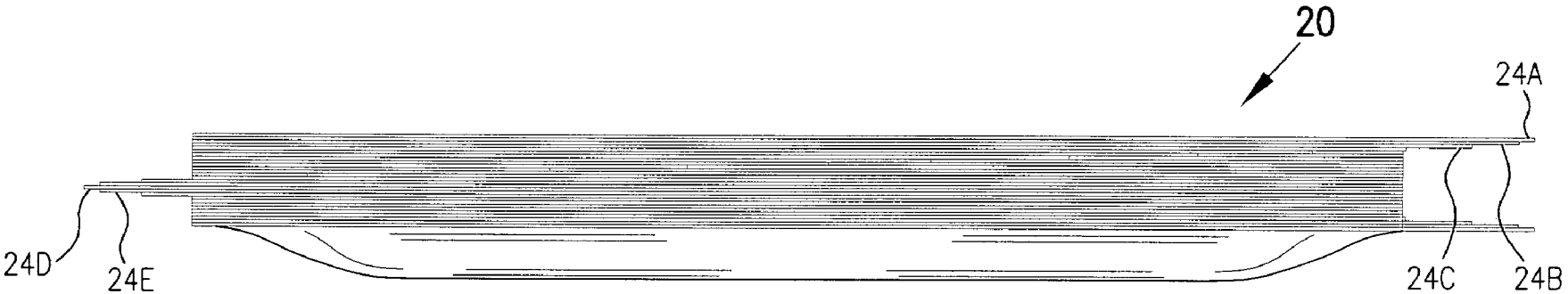
FIG. 5 is a side view of the disposable plate stack.
Figure 6:
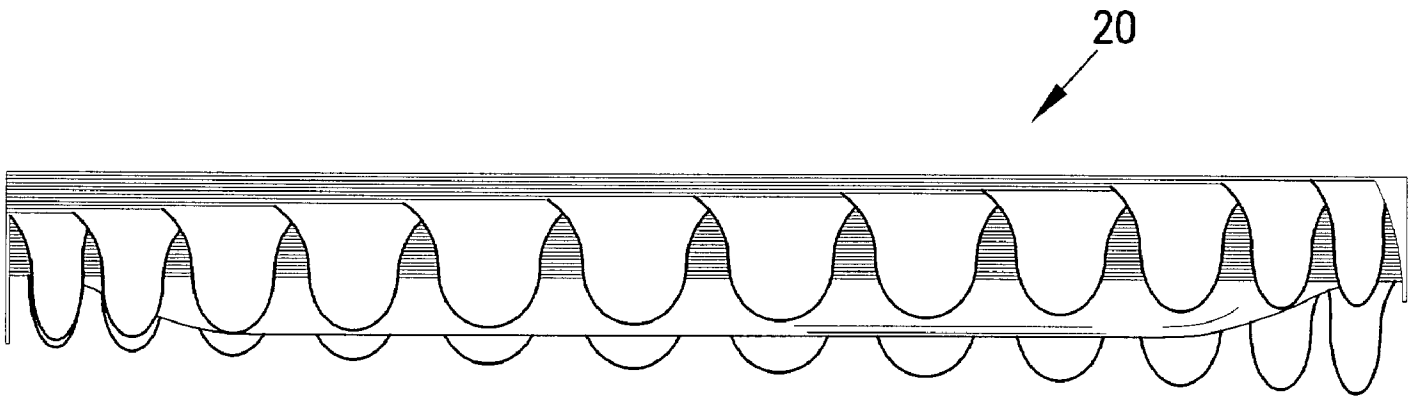
FIG. 6 is a side view of the disposable plate stack with handle portions folded downward.

FIG. 5 depicts a side view of a plurality of disposable plates in a stacked condition 20 with corresponding handle portions 24A, 24B, 24C, 24D, 24E. FIG. 6 depicts a side view of a plurality of disposable plates in a stacked condition 20 with corresponding handle portions folded downward along the peripheral surface of said disposable plate stack.

Although the description above contains many details, they should not be construed as limiting the scope of the present invention, but as merely providing illustrations of one of the presently preferred embodiments of the invention. Those skilled in the art will recognize that other and further changes and modifications may be made thereto without departing from the spirit of the invention. Therefore, the invention is not limited to the specific details and representative embodiments shown and described herein. Various modifications may be made without departing from the spirit or scope of the general inventive concept as set forth above.

What is claimed is:

1. A disposable plate stack, comprising:

a plurality of disposable plates, each of said disposable plates comprising a main body portion having a center, a substantially planar bottom portion and an outwardly sloping sidewall portion; and a handle portion disposed on the peripheral edge of said disposable plates, wherein the perimeter of said handle portion does not extend beyond a boundary defined by a square having the same center as said main body portion of said disposable plates, said square having sides equal in length to the diameter of said main body portion of said disposable plates;

wherein said disposable plates are vertically stacked upon each other to form a stack, and said disposable plates are configured and arranged such that said handle portions are circumferentially staggered such that no such handle portion rests upon the handle portion of an adjacent disposable plate; and wherein each of said handle portions are folded downward along the outer peripheral surface of said disposable plate stack.

2. The disposable plate stack of claim 1, each of said disposable plates having a score line which defines the arcuate line between said main body portion and said handle portion.

3. A method of stacking disposable plates, comprising the steps of:

providing a plurality of disposable plates, each of said disposable plates comprising a main body portion having a center, a substantially planar bottom portion and an outwardly sloping sidewall portion; and a handle portion disposed on the peripheral edge of said disposable plates, wherein the perimeter of said handle portion does not extend beyond a boundary defined by a square having the same center as said main body portion of said disposable plates, said square having sides equal in length to the diameter of said main body portion of said disposable plates;

vertically stacking said disposable plates upon each other to form a stack, such that said handle portions are circumferentially staggered such that no such handle portion rests substantially upon the handle portion of an adjacent disposable plate;

folding each of said handle portions downward along the outer peripheral surface of said disposable plate stack;

whereby a disposable plate user may efficiently separate said disposable plates from said stack.

4. The method of claim 3, further comprising:

scoring each of said disposable plates along the line which defines the arcuate line between said main body portion and said handle portion.

* * * * *